US007547863B2

(12) United States Patent
Hardesty et al.

(10) Patent No.: US 7,547,863 B2
(45) Date of Patent: Jun. 16, 2009

(54) SYSTEM AND METHOD FOR CONTROL OF SUPPLEMENTAL APPLIANCES

(75) Inventors: Ryan Hardesty, Chesterton, IN (US); Jeff Jelinek, Hammond, IN (US)

(73) Assignee: SPX Corporation, Charlotte, NC (US)

( * ) Notice: Subject to any disclaimer, the term of this patent is extended or adjusted under 35 U.S.C. 154(b) by 152 days.

(21) Appl. No.: 11/312,497

(22) Filed: Dec. 21, 2005

(65) Prior Publication Data

US 2007/0138163 A1 Jun. 21, 2007

(51) Int. Cl.
*H05B 1/02* (2006.01)

(52) U.S. Cl. ..... 219/482; 219/486; 219/508; 219/481; 219/492; 307/38

(58) Field of Classification Search ..... 219/481–486, 219/492, 494, 497, 499, 501, 505, 507, 508; 307/38–41

See application file for complete search history.

(56) References Cited

U.S. PATENT DOCUMENTS

| | | | | |
|---|---|---|---|---|
| 4,852,360 | A * | 8/1989 | Harshbarger et al. | 62/126 |
| 5,718,372 | A * | 2/1998 | Tishler | 236/11 |
| 5,752,654 | A * | 5/1998 | Mowery et al. | 237/2 B |
| 5,805,856 | A * | 9/1998 | Hanson | 392/465 |
| 6,223,545 | B1 | 5/2001 | Kinkel et al. | |
| 6,276,148 | B1 * | 8/2001 | Shaw | 62/117 |

FOREIGN PATENT DOCUMENTS

GB 1019748 A 2/1966

* cited by examiner

*Primary Examiner*—Mark H Paschall
(74) *Attorney, Agent, or Firm*—Baker & Hostetler LLP

(57) ABSTRACT

A system and method for controlling one or more appliances includes a control system where one appliance is in a condition such as having operated at full capacity for a predetermined period of time, and activation signal is sent to a secondary appliance. Appliances may be linked together to control each other, so that when a second appliance is operating at full capacity a third appliance is activated and so on.

8 Claims, 2 Drawing Sheets

HEATED FLUID SUPPLIED TO SYSTEM
FLUID FROM SYSTEM
CALL FOR HEAT INITIATED BY ZONE THERMOSTAT
CALL FOR HEAT INITIATED BY APPLIANCE #1
CALL FOR HEAT INITIATED BY APPLIANCE #2
CALL FOR HEAT INITIATED BY APPLIANCE #3
10
12
14
16
18
20
22
24
26
28
30
32
34
C1
C2
C3
T

SYSTEM AND METHOD FOR CONTROL OF SUPPLEMENTAL APPLIANCES

FIELD OF THE INVENTION

The invention generally pertains to the field of electrical appliances, such as for example, environmental heating or cooling devices used in building heating and air conditioning. More particularly, the invention pertains to the control of such appliances, including for example, heaters and air conditioners, and to the activation and deactivation of such appliances.

BACKGROUND OF THE INVENTION

Heating and cooling appliances are in wide use in buildings and in residential and/or commercial industry. Examples of such heating and cooling devices include air conditioning units, heat pumps, gas fired boilers, gas fired furnaces, circulating solar water heaters, and a wide variety of other equipment that is used to provide heating or cooling to an atmosphere such as for example a building atmosphere, or to a process fluid in industry. Other types of appliances are also used to provide heating or cooling to environmental or industrial systems. For example, a storage room such as a refrigerated cold box requires cooling to be applied. Also, many industrial processes require the heating or cooling of a fluid. For example, in an industrial process where a vessel is heat jacketed or cold jacketed, the fluid will be heated or cooled using some form of heating device or chilling device.

In most of systems, it is typical to have an on/off type thermostat device that senses the temperature of the environment compared to a predetermined desired temperature, and turns the heating and/or cooling device or other appliance on or off to add heating or cooling energy inputs to the environment. A wide variety of simple and programmable thermostats is known, which turn the system on or off when the deviation from the desired temperature exceeds a predetermined threshold.

The above described systems suffer from drawbacks however. Because the heating and cooling requirements of many all environments will vary from time-to-time, the heating or cooling appliance is generally over-designed so that when necessary it can overcome maximum loads. Consequently, the entire device is cycled on and off, therefore sometimes causing a number of cycles, which may be somewhat energy inefficient. One solution to this problem is to reduce the design limits of the system, however in some instances then it will not be able to meet peak demand loads. Another solution is to over-design the system to meet peak demand loads, which causes the system to become more expensive and as mentioned above, to go through cycles which may have an inefficient start-up and shut-down times. Further, such a cycling type of input may in some instances lead to swings in the temperature of the environment, which may be acceptable in some environments, but may not be acceptable in environments where it is desired to hold the temperature in an extremely even condition.

Also, use of a single large system can preclude the use of some systems such as solar water heating, which may be sometimes but not always available due to the weather.

In view of the foregoing, there is a need in the art for a system for control of appliances such as heating and cooling devices which can respond to changes in heating or cooling load in a desirable manner, while also reducing the total cost of the system and/or improving the energy efficiency of the system.

SUMMARY OF INVENTION

The present invention provides a system and method for the control of appliances, such as for example, heating and cooling appliances, and more particularly, for example, environmental heaters and air conditioners.

In accordance with one embodiment of the present invention, an appliance for heating or cooling an environment, comprising a switch that receives an input from an external device to activate the appliance; a monitoring device that senses an operation level and/or operation time of the appliance; and a controller that sends an activation signal to another appliance when the operation level and/or time of the appliance exceeds a predetermined value.

In accordance with another embodiment of the present invention, a system for heating or cooling an environment comprises a primary appliance, comprising a switch that receives an input from an external device to activate the primary appliance; a monitoring device that senses an operation level and/or operation time of the primary appliance; and a controller that sends an activation signal to a supplemental appliance when the operation level or the time of the appliance exceeds a predetermined value; and a supplemental appliance comprises a switch that receives an input from the primary appliance to activate the supplemental appliance; a monitoring device that senses an operation level and/or operation time of the primary appliance; and a controller that sends an activation signal to another supplemental appliance when the operation level and/or the time of the appliance exceeds a predetermined value.

In accordance with yet another embodiment of the present invention, an appliance for heating or cooling an environment comprises a controller that senses a condition of the appliance and sends an activation signal to another appliance when the condition meets one of the one or more predetermined conditions.

In accordance with yet still another embodiment of the present invention, a method for heating or cooling an environment comprises receiving an input from a thermostat to turn an appliance on or off to operate at a designated level; determining the operation level and/or operation time of the appliance; and sending an activation signal to another appliance when the operation level and/or time of the appliance exceeds a predetermined value.

In accordance with another embodiment of the present invention, an appliance for heating or cooling an environment comprises a means for receiving an input from a thermostat to turn appliance on or off to operate at a designated level, means for determining the operation level and/or operation time of the appliance, and means sending an activation signal to another appliance when the operation level and/or time of the appliance exceeds a predetermined value.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides a system and method for the control of appliances, such as for example, heating and cooling appliances, and more particularly, for example, environmental heaters and air conditioners.

Some preferred embodiments are discussed below is in the context of a heating system having a plurality of heating devices. However, it will be readily appreciated that any form of appliance may be controlled in the same fashion. In particular, for example, the appliances being controlled may be any kind of heating devices and/or air conditioning devices. These include without limitation, for example, gas fired furnaces, gas fired boilers, coal fired boilers, oil heaters, electric furnaces, heat pumps, air conditioning devices, chillers, fireplaces, cooling towers, or any other thermal system, including for example, solar heated circulating water systems, etc. Furthermore, the control system of this invention may also be applied to other appliances, such as refrigerators, ovens, or other systems that impart energy into an environment.

Figure 1:
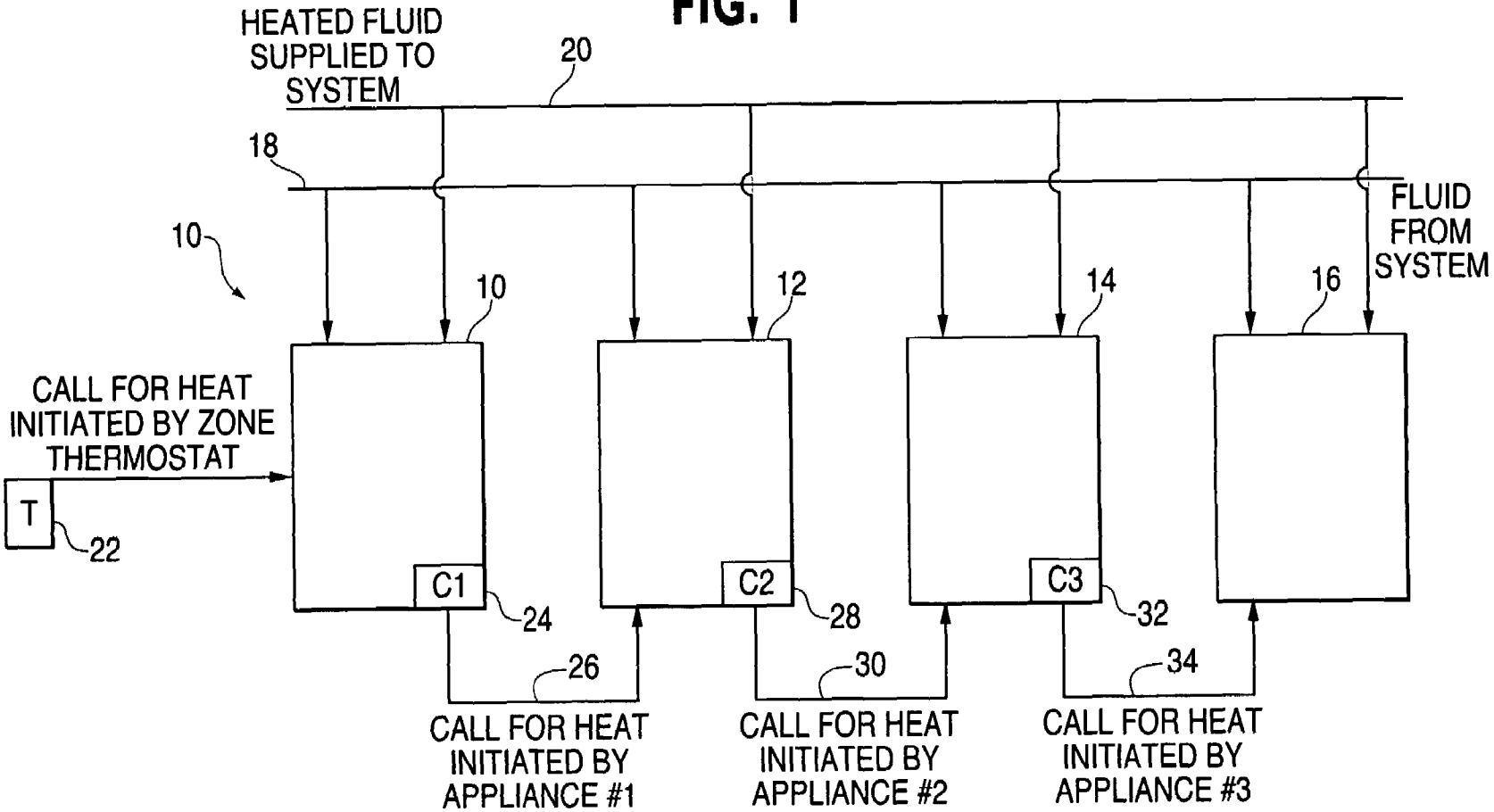
FIG. 1 is a schematic diagram of a heating or cooling appliance system according to a preferred embodiment of the present invention, including a plurality of individual appliances, and including a control system for controlling the appliances.

Referring now to FIG. 1, a preferred embodiment 10 is depicted with four appliances 10, 12, 14, and 16, which each receive fluid from an input conduit 18 and heat the fluid and return it to an output conduit 20. This may include for example a system providing hot water to a hot water heating system that utilizes radiators to warm in the environment.

The first appliance 10 is controlled by a thermostat 22 in a conventional manner. Thus, it will be appreciated that the system provides a benefit that it can be implemented without any modification of the thermostat 22 or its connection to the first appliance 10.

If the first or primary appliance 10 operates at its full firing capacity (or other predetermined capacity) for a predetermined period of time, a controller 24 associated with the primary appliance 10 sends a signal via a communication path 26 to a supplemental appliance 12. The controller 24 may have a separate monitoring device, control processes, and relay suitable, or may be of any other design, such as a programmable logic computer system. The signal will activate the first supplemental appliance 12 so that it also operates to provide supplemental capacity, in this instance supplemental heating. In this way, the primary appliance 10 does not need to be designed to accommodate the full load applied to the system. When a first supplemental appliance 12 has been operating for some time, it will provide satisfactory heat load, and the environment will reach its desired temperature, causing the thermostat 22 to turn-off the primary appliance 10. The controller 24 of the primary appliance 10 will also turn-off the first supplemental appliance 12 at this time. When heat is again needed, the above process can be repeated.

FIG. 1 also shows a secondary supplemental appliance 14 and third supplemental appliance 16. These are connected in a serial or "daisy-chain" fashion, so that the first supplemental appliance 12 has a controller 28 communicating via a line 30 with the second supplemental appliance 14. Thus, in this system, if both the primary appliance 10 and the first supplemental appliance 12 are running, and the supplemental appliance 12 runs at a full or predetermined capacity for a predetermined period of time, the controller 28 of the first supplemental appliance 12 sends a signal that activates the second supplemental appliance 14. The second supplemental appliance 14 also has a controller 32 which can send a control signal over a communication line 34 to a third supplemental appliance 16 turning it on if the second supplemental appliance 14 has been at operating at a predetermined level for a predetermined period of time.

From the above, it can be seen that the system of FIG. 1, provides a number of operational advantages. First, each of the appliances in the chain 10, 12, 14, 16 can be selected to be a suitable size, cost, efficiency and durability. Thus, for example, the primary appliance 10 may in some instances be a main appliance which is efficient and robust, and is expected to operate most all of the time. The supplemental systems might be expected to operate less of the time and thus of a different type entirely and/or have different durability and capacity specifications.

Other options are also made available by the present invention. For example, the primary appliance 10 may be a highly cost effective but limited-capacity system, such as in some examples a solar water heating system. Thus, the primary appliance 10 would operate most of the time leading to cost savings and/or energy efficiencies. But when peak loads are required that cannot be accommodated by the low cost solar power, a supplemental heater 12 such as a convention fuel fired heater can be operated only when needed.

The arrangement shown in FIG. 1 has many other benefits. For example, the entire system can be operated from a single thermostat regardless of how many appliances are linked together. Each appliance can have a simple design wherein it has its own controller that simply needs to detect how long the appliance has been activated, or optionally, at what level the appliance has been operating and for what period of time. The controller then simply needs to provide an on/off signal to the next appliance. Each of the appliances can thus be configured to receive a simple on/off control either from a thermostat or from another appliance. Also, each appliance simply needs to have a controller that monitors simple conditions of the appliance and provides an output which will be used if the appliance is linked serially, or "daisy-chained" together with another. In this way, the system can minimize cost and complexity compared to a centralized thermostat or control system, and also provides ready interchangeability and adaptability in the field. The controllers of the appliances can be further provided with a feature wherein they sense their own failure. Thus, if the system fails the controller will activate the next appliance.

Although FIG. 1 shows an example having four appliances, it will be readily appreciated that the system can have two or any greater number of appliances.

In another optional feature, each of the controllers may be provided with a simple appliance deactivation switch. When this deactivation switch is turned-off, that appliance will not function, but the controller associated with that appliance will send an activation signal to the next higher associated appliance. This can be useful for example, where different types of fuels are used by the different appliances and fuel costs are changing. Thus, if the primary appliance is designed to use the type of fuel that becomes expensive, it is very easy for an operator to turn the deactivation switch for that appliance, and it will automatically notify the next appliance to begin operating when it receives a call from the thermostat.

The activation of a second or next appliance from a first or previous appliance is sometimes referred to as a "call for help." That is, in these embodiments of the invention, when an appliance is in a condition such as operating at full capacity for a period of time, broken, or set into a deactivated state, when that appliance is asked by a thermostat or another appliance to operate, it can issue a "call for help" to another appliance in the line which will then provide supplemental energy to the system. In some embodiments, each appliance can have several components including: a component considered a switch that receives an activation input, such as from a thermostat or other appliance; a component considered a monitoring device that senses the operation level and/or time of the appliance; and a controller that sends an activation signal to another appliance. These components however do not need to reside in separate physical devices. That is, all of the components may reside for example on a single circuit board or in an integrated single device or computer, or they may reside for example on several individual discrete circuitry or logic devices. Also these functions can be carried out using software or program logic that is present in a single integrated device or in several discrete devices. The software or program logic similarly may be a single program or a number of separated programs.

Another benefit of this system is that it can provide flexibility to an operator who has multiple installations in multiple environments. For example, a system may be designed to utilize a single appliance 10 during most of the year, but during a time of the year when peak loads are experienced, a second appliance 12 and/or third appliance 14 and so on can be transported to the location and operated. The supplemental appliances can be in some instances smaller and portable than the primary appliance. In cases of seasonal change, the supplemental appliances can be removed from one location where they are not needed and transported to another location and operated at that location. Further, the supplemental appliances as noted above can sometimes be much less expensive and/or cumbersome than the main appliance, or vice-versa.

Figure 2:
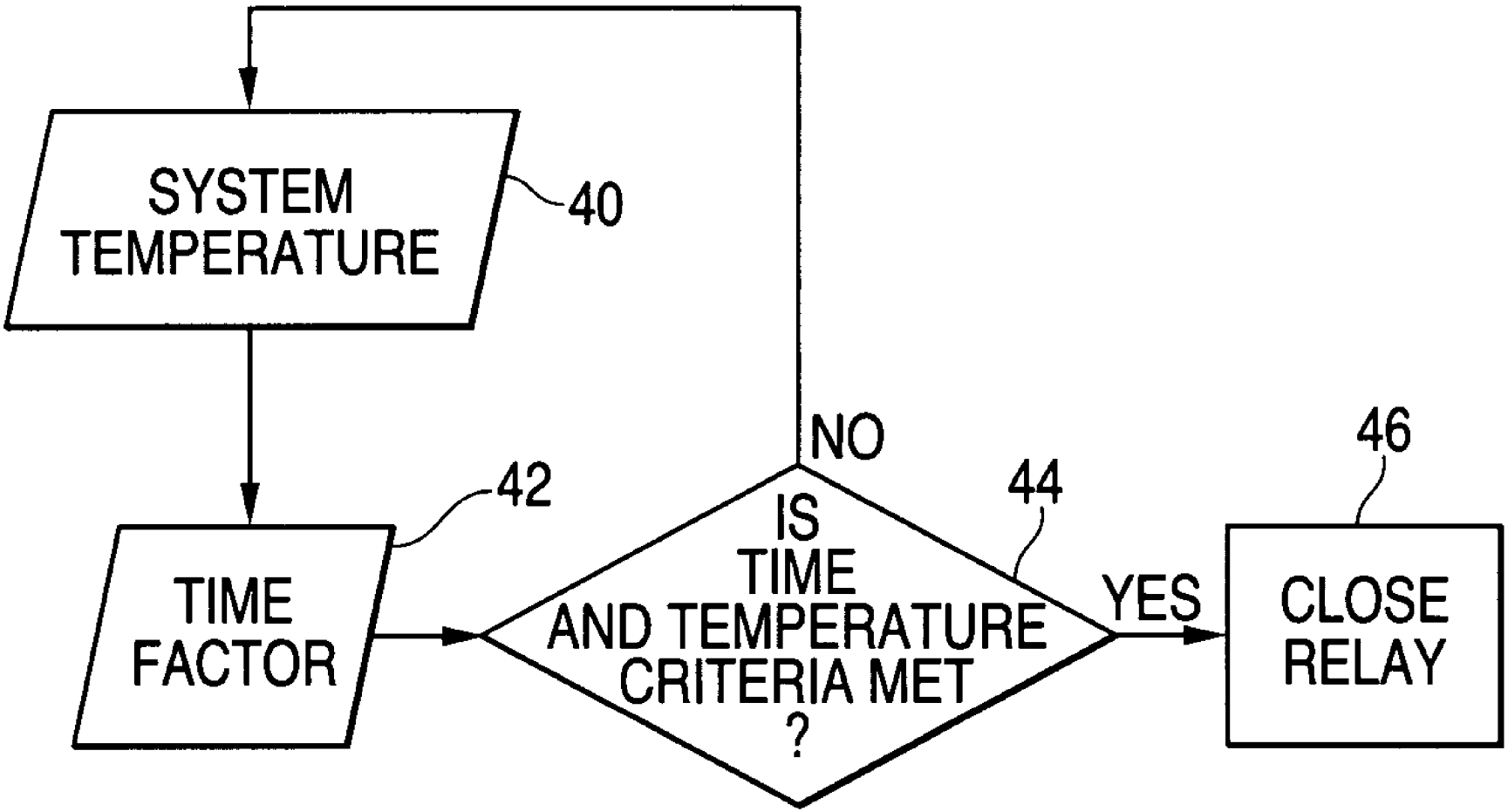
FIG. 2 is a flow chart showing steps used in a control system of FIG. 1.

FIG. 2 is a flow chart illustrating steps implemented in some embodiments in the invention. For example, at step 40 the temperature of the environment is measured. In some instances, such as a building environment, the temperature may be measured by a typical ambient thermostat, or in the case of an individual process, may be measured by a thermocouple or other device depending on the environment being maintained. At step 42, the control system determines whether it has been operating at full (or predetermined) heating capacity for longer than a predetermined period of time. If the time and temperature criteria are not met at step 44, the system continues operating based on inputs from the thermostat at step 40. However, if the time and temperature criteria are met, then the respective controller closes a relay or in some other fashion activates a supplemental appliance (the next appliance in line). That is, at step 46 the system "calls for help" from its assigned neighboring appliance.

The control signal paths 26, 30, and 34 can be wired or wireless or other types of communication. Similarly, the control path from the thermostat 22 to the first appliance 10 may also be wired or wireless.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed:

1. A system for heating or cooling an environment, comprising:

a primary appliance, comprising:

a switch component that receives an input from an external control device to activate the primary appliance;

a monitoring device component that senses an operation level and the operation time of the primary appliance; and a controller component that sends an activation signal to a supplemental appliance when the operation level and the operation time of the appliance exceeds a predetermined value; and a second appliance comprising:

a switch component that receives an input from the primary appliance to activate the supplemental appliance;

a monitoring device component that senses an operation level and the operation time of the primary appliance; and a controller component that sends an activation signal to another supplemental appliance when the operation level and the operation time of the appliance exceeds a predetermined value, wherein the primary appliance is independently operable for control solely by the external control device, and the second appliance is operable by itself to be controlled solely by the external control device, and wherein the primary appliance and the second appliance can be linked to each other so that the primary appliance is controlled by the external control device and the secondary appliance is controlled by the controller component of the primary appliance.

2. The system according to claim 1, wherein the second appliance comprises at least one of a furnace, a boiler, a heat pump, and/or an air conditioner.

3. The system according to claim 1, wherein the external device is a thermostat.

4. The system according to claim 1, wherein the primary appliance controller closes a relay to provide the operation signal to the second appliance.

5. A system for heating or cooling an environment, comprising:

a primary appliance, comprising:

means for receiving an input from an external control device to activate the primary appliance;

means for sensing an operation level and the operation time of the primary appliance; and means for sending an activation signal to a supplemental appliance when the operation level and the operation time of the appliance exceeds a predetermined value; and a second appliance comprising:

means for receiving an input from the primary appliance to activate the supplemental appliance;

means for sensing an operation level and the operation time of the primary appliance; and means for sending an activation signal to another supplemental appliance when the operation level and the operation time of the appliance exceeds a predetermined value, wherein the primary appliance is operable by itself to be controlled solely by the external control device, and the second appliance is independently operable for control solely by the external control device, and wherein the primary appliance and the second appliance can be linked to each other so that the primary appliance is controlled by the external control device and the secondary appliance is controlled by the activation signal sending means of the primary appliance.

6. The system according to claim 5, wherein the second appliance comprises at least one of a furnace, a boiler, a heat pump, and/or an air conditioner.

7. The system according to claim 5, wherein the external device is a thermostat.

8. The system according to claim 5, wherein the primary appliance sending means closes a relay to provide the operation signal to the second appliance.

* * * * *